US006109743A

United States Patent [19]

Takatsugi et al.

[11] Patent Number: 6,109,743

[45] **Date of Patent: *Aug. 29, 2000**

[54] INK CARTRIDGE, PROCESS FOR FORMING IT AND LIQUID INK FEEDER

[75] Inventors: Masaki Takatsugi, Toyohashi; Makoto Suzuki, Nagoya, both of Japan

[73] Assignee: Brother Kogyo Kabushiki Kaisha, Nagoya, Japan

[ * ] Notice: This patent is subject to a terminal disclaimer.

[21] Appl. No.: 08/998,754

[22] Filed: Dec. 29, 1997

[30] Foreign Application Priority Data

Jan. 8, 1997 [JP] Japan ..... 9-001407

[51] Int. Cl.[7] ..... B41J 2/175

[52] U.S. Cl. ..... 347/86

[58] Field of Search ..... 347/5, 7, 17, 23, 347/84, 85, 86, 87; 222/105

[56] References Cited

U.S. PATENT DOCUMENTS

| | | | |
|---|---|---|---|
| 4,606,776 | 8/1986 | Salis | 134/36 |
| 4,814,794 | 3/1989 | Sato | 347/28 |
| 5,070,346 | 12/1991 | Mochizuki et al. | 347/7 |
| 5,611,461 | 3/1997 | Kubota et al. | 222/105 |
| 5,625,393 | 4/1997 | Asai | 347/69 |
| 5,631,682 | 5/1997 | Takata | 347/86 |
| 5,634,730 | 6/1997 | Bobry | 400/88 |
| 5,971,533 | 10/1999 | Kinoshita et al. | 347/86 |

FOREIGN PATENT DOCUMENTS

| | | |
|---|---|---|
| 0 437 363 A2 | 7/1991 | European Pat. Off. . |
| 0 560 398 A2 | 9/1993 | European Pat. Off. . |
| 0 561 406 A2 | 9/1993 | European Pat. Off. . |
| 0 604 235 A1 | 6/1994 | European Pat. Off. . |
| 0 649 633 A1 | 4/1995 | European Pat. Off. . |
| 0 720 915 A2 | 7/1996 | European Pat. Off. . |
| 0 738 605 A2 | 10/1996 | European Pat. Off. . |
| 0 745 481 A2 | 12/1996 | European Pat. Off. . |
| 0 755 795 A2 | 1/1997 | European Pat. Off. . |
| 0 795 409 A1 | 9/1997 | European Pat. Off. . |
| 54-151033 | 11/1979 | Japan . |
| 5-116326 | 5/1993 | Japan . |
| 5-138895 | 6/1993 | Japan . |
| 7-323559 | 12/1995 | Japan . |
| 8-295096 | 11/1996 | Japan . |
| 9-298568 | 11/1996 | Japan . |
| 9-85994 | 3/1997 | Japan . |

*Primary Examiner*—N. Le
*Assistant Examiner*—Anh T. N. Vo
*Attorney, Agent, or Firm*—Oliff & Berridge, PLC

[57] ABSTRACT

An ink cartridge takes the form of a bag, and is formed out of a laminate which includes films laminated together. Compressive stress exists in one of the films. Therefore, when a hollow needle pierces the bag, the stress causes this film to function in such a manner as to block the pierced hole. This brings the film into close contact with the needle, preventing ink leakage securely. It is also possible to prevent the cracks developed in the laminate by external injuries from progressing. It is possible to form the laminate by bonding a plurality of films having different coefficients of thermal expansion together at high temperature, and cooling the bonded films. It is possible to form the bag by heat-sealing the laminate.

30 Claims, 5 Drawing Sheets

INK CARTRIDGE, PROCESS FOR FORMING IT AND LIQUID INK FEEDER

BACKGROUND OF THE INVENTION

1. Field of the Invention

The present invention relates to an ink cartridge and a liquid ink feeder for storing liquid ink for use with an ink jet printer or another printer and feeding the ink to the printer.

2. Description of Related Art

A conventional method of feeding liquid ink to an ink jet printer or another printer includes storing liquid ink in an ink tank made of resin, and mounting the tank on the print head of the printer. The amount of the ink remaining in the tank can be determined by the transmittance of a light illuminated through the tank. Otherwise, the remaining ink amount can be determined by the electrostatic capacity between two electrodes fitted in the tank.

These methods necessitate making an ink tank suitable for a particular mechanism for detecting the remaining ink amount. As a result, the ink feeder is complex in structure. In addition, because the tank is not compatible among types of machines, the tank production costs are high.

FIG. 1 of the accompanying drawings shows part of a conventional liquid ink feeder 12 for an ink jet printer. The feeder 12 includes a tubular needle 16. Liquid ink is stored in an ink cartridge 10 in bag form made of synthetic resin film. The needle 16 can pierce the bottom 11 of the cartridge 10 and protrude into the cartridge. The ink can then be fed from the cartridge 10 through the needle 16 to the print head (not shown) of an ink jet printer.

As shown in FIG. 7 of the drawings, the cartridge 10 is made of multilayer film 303 including an inner synthetic resin film 300 and an outer synthetic resin film 302, which are laminated together. The inner film 300 is a good barrier, and may be a biaxial oriented film of polyethylene (OPP), a biaxial oriented film of high density polyethylene (HDPE), a uniaxial oriented film of high density polyethylene, or the like. The outer film 302 is high in mechanical strength, and may be a uniaxial or biaxial oriented film of nylon, polyester or the like, which is strong mechanically.

When the needle 16 pierces the multilayer film 303, as shown in FIG. 7, cracks 300*a* are liable to develop in certain directions in the outer layer 302 under the influence of the crystal orientation due to the drawing. The cracks 300*a* propagate to the inner layer 300. Air may enter the cartridge 10 through the cracks, and mix with the ink in the cartridge. The mixture may cause defective operation of the print head of the printer. Ink may leak through the cracks.

The inner layer 300 may be OPP, HDPE or other synthetic resin film which both functions as a barrier and has mechanical strength. In this case as well, cracks are liable to develop in certain directions.

Particularly, if the feeder 12 is used with a hand-held or portable ink jet printer as disclosed in Japanese Patent application Laid-Open Publications No. 8-295096, No. 8-298568, No. 9-;85994 and U.S. Pat. No. 5,634,730, the ink in the cartridge 10 expands with the operator's vital warmth. As a result, a large amount of liquid ink may leak through the cracks and through the pierced hole of the cartridge 10 around the needle 16. The operator's hands, recording paper, etc. may be smeared with ink. The leaked ink may break the electrical equipment in the printer.

In order to find the amount of the ink remaining in the cartridge 10, it is necessary to detect the level of the remaining ink. This necessitates fitting a plurality of optical or light sensors at predetermined longitudinal intervals, thereby increasing the production costs.

SUMMARY OF THE INVENTION

It is an object of the present invention to provide a leak-free liquid ink feeder including an ink storage and feed device which is simple in structure and which can be made cheaply, and also including a relatively simple mechanism which can detect the amount of remaining liquid ink.

In accordance with a first aspect of the invention, an ink cartridge is provided, which includes a sealed bag filled with ink. The bag is formed out of a laminate which includes films different in ductility. The bag is formed in such a manner that compressive stress develops in in-plane directions in at least one of the films.

As stated above, the laminate includes films different in ductility. More ductile films are higher in elongation or breaking elongation. Less ductile films are generally higher in tensile strength, and strong against external injuries as well. Therefore, the laminate is strong against external injuries and has such a sealing effect that, when it is pierced by a hollow needle or another member for taking out ink, the pierced hole is blocked. In particular, if this cartridge is used with an ink jet printer, it is possible to, on the basis of the sealing effect, maintain good meniscuses at the nozzles of the ink jet head of the printer for the following reason.

When a hollow needle or another needle has pierced the bag, and as ink is sucked (consumed) from the bag through the passage in the needle, the volume of ink in the bag decreases. Because the material of the bag has restoring force, the bag volume does not decrease as ink is consumed. As a result, negative pressure develops in the bag and forces the ink in the nozzles of the ink jet head back toward the cartridge.. The negative pressure maintains the ink meniscuses formed at the front ends of the nozzles. It is therefore not necessary for the cartridge to house a foamed member in it as is the case with conventional ink cartridges.

Compressive stress exists in at least one of the films. When a hollow needle pierces the bag (laminate), the stress causes this film to function in such a manner as to block the pierced hole. This brings the film into close contact with the needle, preventing ink leakage securely. It is also possible to prevent the cracks developed in the laminate by external injuries from progressing.

It is possible to form the laminate by bonding a plurality of films having different coefficients of thermal expansion together at high temperature, and cooling the bonded films. If the outmost film has a higher coefficient of thermal expansion, compressive stress can develop on the outside of the bag.

In order to make the sealing effect more secure, it is preferable that the laminate include a rigid film and a ductile film. The ductile film may be made of polyethylene, polypropylene or other polyolefine resin, which is high in strength and good as a gas barrier.

The laminate may include at least one non-oriented synthetic resin film. Because the non-oriented film has no crystal orientation, cracks are not liable to develop in it when it is pierced by a hollow needle.

It is preferable that the inmost film of the laminate, which is in contact with the ink, function as an ink sealing layer, and that this layer be more ductile than any other layer of the laminate. The laminate may also include adhesive layers each between adjacent two of the films. When a hollow needle pierces the laminate, the adhesive layers bring the needle and the laminate into closer contact with each other, making the ink sealing effect more secure. Even if cracks develop in the surfaces of the laminate, the adhesive layers prevent the cracks from propagating.

The rigid film may be a non-oriented nylon film. In order to prevent ink leakage, the ductile film may be a linear chain low-density polyethylene (LLDPE) film. These films may be bonded to each other with a urethane adhesive layer.

It is possible to produce the bag easily by folding the laminate in two and heat-sealing adjacent edges of the folded laminate.

In accordance with a second aspect of the invention, a process is provided for forming an ink cartridge in bag form which includes films laminated together. The process comprises the steps of:

forming a laminate by bonding a first layer and a second layer, which has a higher coefficient of thermal expansion than the first layer, through an adhesive layer at high temperature;

cooling the laminate to develop compressive stress in the first layer;

folding the cooled laminate in two; and bonding adjacent edges of the folded laminate together to form an ink cartridge in bag form.

Because the layers having different coefficients of thermal expansion are bonded together at high temperature, it is possible to develop compressive stress effectively in one of the layers of the formed laminate. Therefore, when a hollow needle pierces the cartridge, the stress causes this layer to function in such a manner as to block the pierced hole. This brings the film into close contact with the needle, preventing ink leakage securely. It is also possible to prevent the cracks developed in the laminate by external injuries from progressing.

In accordance with a third aspect of the invention, an ink feeder is provided, which includes an ink head for ejecting ink and a needle. The needle has an ink passage formed therein, which communicates with the head. The feeder also includes a sealed ink cartridge in bag form which is filled with ink. The cartridge is formed out of a laminate which includes films different in ductility. The cartridge is formed in such a manner that compressive stress develops in at least one of the films. The needle can pierce the cartridge in order to feed ink out of the cartridge to the head.

Ink can be taken out of the cartridge through the needle and fed to the head, which ejects the ink onto a printing medium.

As stated above, the laminate includes films different in ductility. Therefore, the laminate is strong against external injuries and has such a sealing effect that, when it is pierced by the needle, the pierced hole is blocked. If this feeder is used with an ink jet printer, it is possible to, on the basis of the sealing effect, maintain good meniscuses at the nozzles of the ink jet head of the printer, for the reason stated with regard to the first aspect of the invention.

Compressive stress exists in at least one of the films. When the needle pierces the bag (laminate), the stress causes this film to function in such a manner as to block the pierced hole. This brings the film into close contact with the needle, preventing ink leakage securely. It is also possible to prevent the cracks developed in the laminate by external injuries from progressing.

It is possible to take out ink from the cartridge by only piercing the cartridge with the needle. The feeder can therefore prevent ink leakage securely with simple structure while feeding ink.

The feeder may also include a box for housing the cartridge therein and a sensor fitted on an inner surface of the box. In order to find out the amount of the ink remaining in the cartridge, the sensor can detect the contact pressure applied thereto by the cartridge. The sensor might instead be a sensor for detecting the resistance or the capacitance between it and the cartridge in order to find out the amount of the remaining ink.

The needle may taper. When the tapered needle pierces the laminate, the pierced hole becomes large gradually, thereby preventing cracks from developing around the hole. The needle may otherwise be thicker toward its front end. After this needle pierces the laminate, the needle can be prevented from slipping out of the cartridge. The needle may instead be tubular and include a protrusion formed on its periphery. The protrusion can prevent the needle from coming out of the cartridge pierced by the needle.

BRIEF DESCRIPTION OF THE DRAWINGS

Preferred embodiments of the invention are shown in the accompanying drawings, in which.

DETAILED DESCRIPTION OF PREFERRED EMBODIMENTS

Figure 1:
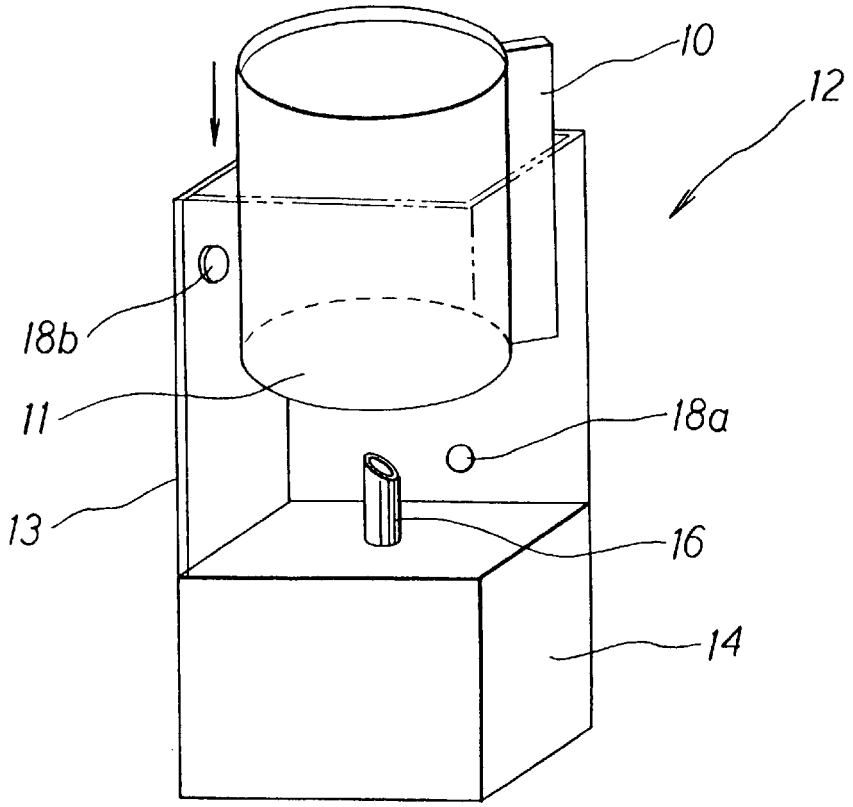
Fig. 1 (Prior Art)
FIG. 1 is a schematic perspective view of a liquid ink feeder according to the invention, also showing part of a conventional liquid ink feeder.

With reference to FIG. 1, the liquid ink feeder 12 of an ink jet printer includes a box or case 13, which is shown as transparent so that the interior of the feeder 12 can be seen. The feeder 12 also includes an ink jet drive 14 positioned at the bottom of the box 13. A tubular needle 16 extends from the drive 14 into the box 13. Two sensors 18*a* and 18*b* are mounted on inner surfaces of the box 13.

The drive 14 prints a sheet of paper by injecting droplets of ink outward (down in FIG. 1) through an injector (ink jet head, not shown), which includes piezoelectric elements, heaters or the like. The injector has ink chambers (not shown) formed in it, each of which communicates with a nozzle of the ink jet head. The piezoelectric elements or the like can change the volume of the chambers to eject ink out of the chambers through the nozzles. The injector and the drive 14 may be an injector and an ink jet drive as used with an ordinary ink jet printer, or as disclosed in U.S. Pat. No. 5,625,393, for example, the disclosure of which is incorporated herein by reference.

An ink cartridge 10 is an ink storage and feed device (member) in bag form, which is filled with liquid ink. The cartridge 10 is made of synthetic resin film, and has a bottom 11 made of laminated film. The cartridge 10 can be inserted in the box 13 into contact with the inner surfaces of the box and the top of the ink jet drive 14. When the cartridge 10 is inserted, the needle 16 pierces the cartridge bottom 11, so that liquid ink is fed from the cartridge 10 through the needle 16 to the drive 14.

Figure 2:
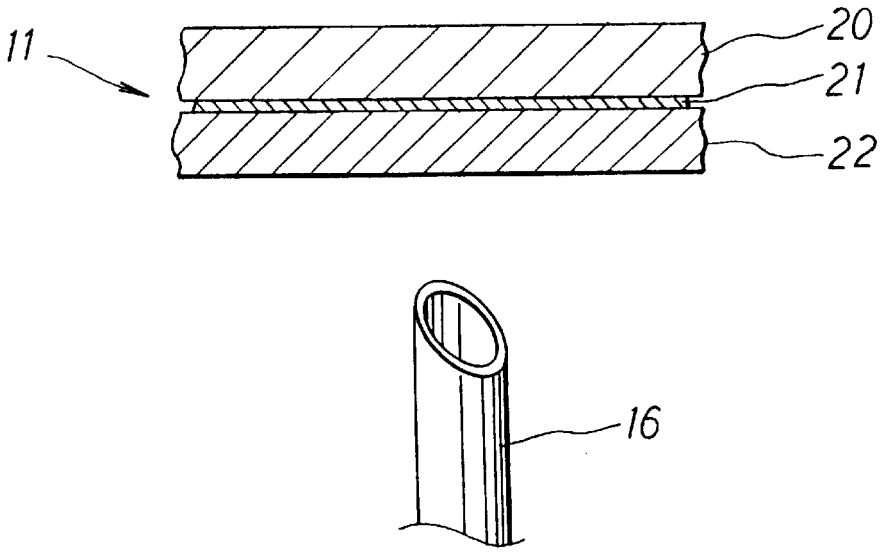
FIG. 2 is an enlarged perspective view, partially in section, of part of the feeder of the invention.

As shown in FIG. 2, at least the bottom 11 of the cartridge 10 is made of laminated film, which includes an inner ductile film 20 as a sealing layer and an outer rigid film 22. The films 20 and 22 are bonded to each other with an adhesive layer 21 interposed between them. The inner film 20 is a synthetic resin film which has a high elongation percentage. The outer film 22 is a synthetic resin film which has a low elongation percentage, and which is high in mechanical strength, such as tensile strength and rigidity.

As defined by JIS K6900, the elongation percentage of a synthetic resin represents the deformation of the resin with respect to a tensile force, and is the ratio of the length of the elongated material to the original or initial length of the material. The elongation percentage until fracture of a material is referred to as the breaking elongation (breaking extension), or simply as the elongation or the elongation percentage, the ductility, or the like of the material. The elongation percentages of various synthetic resin materials are shown on pages 136 and 137 of the first edition of Kimimasa Ito "PLASTIC DATA HANDBOOK" (Kogyo Chosakai), for example.

The laminated film 11 is formed in the following way. The material of the ductile film 20 has a higher coefficient of thermal expansion than the rigid film 22. The films 20 and 22 are bonded to each other with the adhesive layer 21 at high temperature. The bonded films are cooled to room temperature. When the films are cooled, the ductile film 20 shrinks more than the rigid film 22, applying compressive residual stress to the rigid film.

The ductile film 20 may be a non-oriented film of low density polyethylene, polypropylene or other polyolefine, polyvinyl chloride, or the like. Each of these materials has an elongation percentage of 300 or more %. In general, these materials are so good barriers that, if the ductile film 20 is one of them, little gas such as oxygen and steam permeates through the film 20, and mixes with the ink in the cartridge 10.

The rigid film 22 may be a non-oriented film of polyamide nylon or other nylon, polyethylene terephthalate (PET), or polyimide.

The ductile film 20 and rigid film 22 in combination should preferably be a non-oriented nylon film and a linear chain low-density polyethylene (LLDPE) film. Because the films 20 and 22 are not oriented and have no crystal orientation, cracks are not liable to develop in them. Because the compressive residual stress is applied to the rigid film 22 when the laminated film 11 is formed, cracks are not liable to develop in the rigid film 22. When the needle 16 pierces the ductile film 20, the elasticity of this film develops residual stress in the film around the pierced hole in the directions in which the needle 16 is tightened. Even if very small cracks develop in the rigid film 22, the adhesive layer 21 prevents them from propagating to the ductile film 20.

Figure 4:
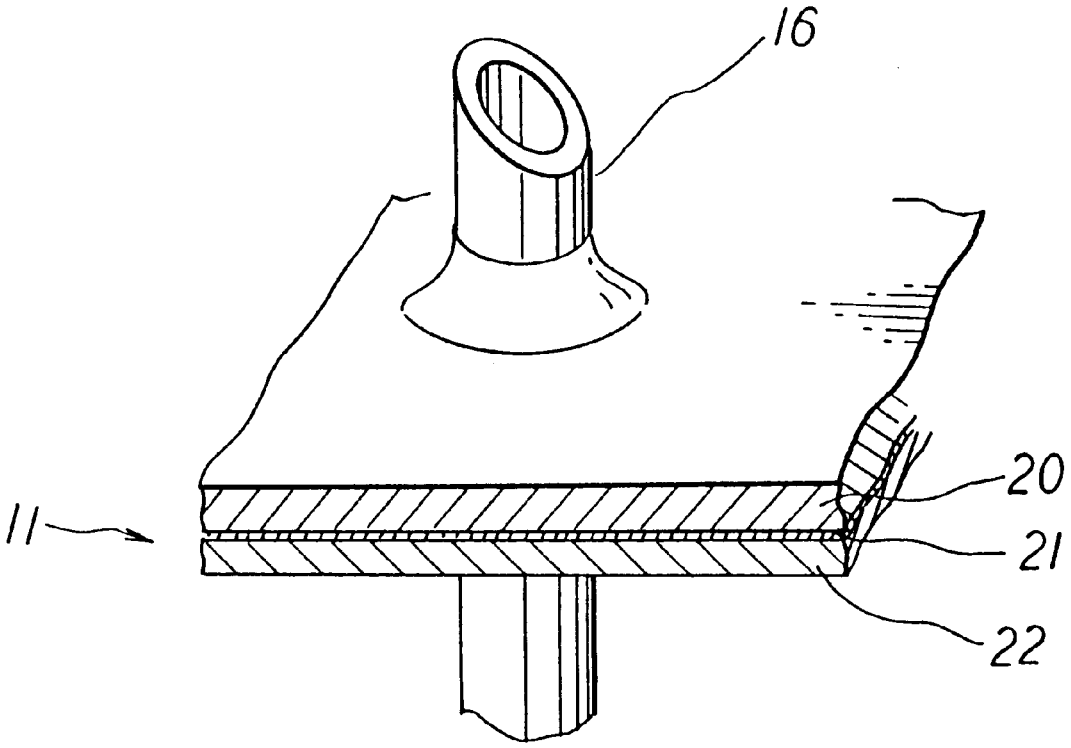
FIG. 4 is a view similar to FIG. 2, but showing the feeder of the invention being used.

Consequently, when the needle 16 pierces the laminated film 11, as shown in FIG. 4, no cracks develop in the ductile film 20 around the pierced hole. This keeps the cartridge 10 closed, preventing the ink from leaking out of it, and outside air from entering it.

If the adhesive layer 21 is a known elastic adhesive such as a urethane adhesive, it is more effective in preventing the cracks from propagating. Besides, when the needle 16 pierces the layer 21, the elastic adhesive is more effective in keeping the outer surface of the needle 16 and the cut surface of the layer 21 in close contact with each other. Therefore, this adhesive is more effective in preventing the ink from leaking out and air from mixing with the ink.

With reference to FIG. 1, the ink in the cartridge 10 can be fed in the following way.

As stated above, the cartridge 10 can be inserted in the box 13 into contact with the inner surfaces of the box and the top of the ink jet drive 14. When the cartridge 10 is inserted, the needle 16 pierces the cartridge bottom 11 of laminated film, so that liquid ink is fed from the cartridge 10 through the needle 16 to the drive 14.

As also stated, the sensors 18*a* and 18*b* are mounted on the inner surfaces of the box 13. Each of the sensors 18*a* and 18*b* may be rubber with electrically conductive filler added to it, or another pressure switch of which the electrical resistivity or specific resistance changes with the pressure applied to the switch. The signals output from the sensors 18*a* and 18*b* represent the contact pressure of the cartridge 10 on the inner surfaces of the box 13. With these signals, it is possible to detect the amount of the ink remaining in the cartridge 10. As stated above, no air can enter the cartridge 10. Therefore, as the amount of the ink in the cartridge 10 decreases, the volume of the cartridge 10 which is relative to the volume of the space around the cartridge decreases. This changes the contact pressure of the cartridge 10 on the inner surfaces of the box 13.

If a large amount of liquid ink remains in the cartridge 10, high pressure is applied to the sensors 18*a* and 18*b*, thereby lowering their electric resistance. If a small amount of liquid ink remains in the cartridge 10, low pressure is applied to the sensors 18*a* and 18*b*, thereby increasing their electric resistance. By detecting the change in electric resistance by means of a circuit system (not shown), it is possible to detect the amount of the remaining ink. The resistance change may be detected by impedance matching with an LCR circuit.

That is to say, it can be detected by means of simple construction or structure and with accuracy, that a large amount of liquid ink remains if the sensors 18*a* and 18*b* are pressed strongly, and that a small amount of liquid ink remains if they are pressed weakly, or if only one or none of them is pressed.

As stated above, the volume of the cartridge 10 changes as the amount of the ink in the cartridge decreases because no air permeates through the cartridge around the pierced hole. Therefore, the cartridge 10 makes it possible to provide even a simple method of detecting the amount of the remaining ink by detecting the cartridge volume change.

Figure 3A:
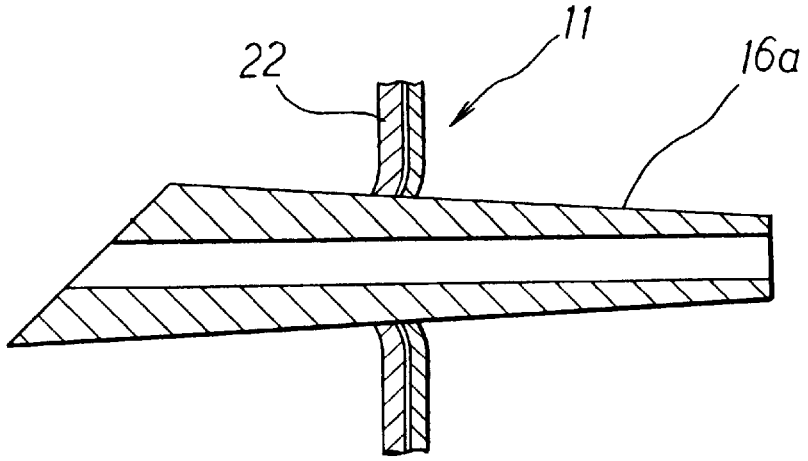
FIGS. 3A, 3B and 3C are cross sections of modified tubular needles for use in the feeder of the invention.

FIG. 3A shows a tubular needle 16*a* which may replace the needle 16. The peripheral surface of this needle 16*a* is conical or taper, and larger in diameter toward the front end of the needle 16*a* (to the left in FIG. 3A).

After this needle 16*a* pierces the cartridge bottom 11, the needle 16*a* does not slip out of the bottom 11 if the pierced hole is not enlarged. It is not easy to enlarge the hole because of the rigidity of the rigid film 22. Therefore, even though the internal pressure of the ink in the cartridge 10 applies force to the needle 16*a* in the direction in which the needle comes out (to the right in FIG. 3A), the needle 16*a* does not slip out. This prevents air from flowing through the pierced hole into the cartridge 10 and mixing with the ink in the cartridge. Consequently, the volume of the cartridge 10 decreases securely or accurately as liquid ink in the cartridge is consumed. This overcomes the problem in a conventional ink feeder that the amount of the ink remaining in the cartridge 10 cannot be detected because air flows into the cartridge. Accordingly, the amount of the remaining ink can be detected always with accuracy. Specifically, the problem is as follows.

In place of the consumed ink, air of the same volume enters the cartridge 10. As a result, even if liquid ink in the cartridge 10 is consumed, the cartridge volume does not vary. Consequently, the contact pressure of the cartridge 10 on the inner surfaces of the box 13 does not change.

Figure 3B:
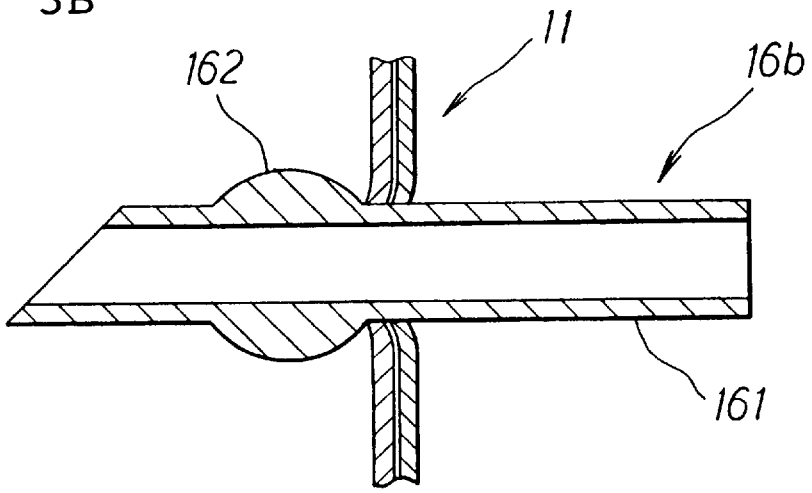

FIG. 3B shows another tubular needle 16*b* which may replace the needle 16. This needle 16*b* includes a cylindrical member 161 having a spherical protrusion 162 formed on its peripheral surface. The needle 16*b* is shaped like a cylinder extending through a ball.

After this needle 16*b* pierces the laminated film 11, the internal pressure of the ink in the cartridge 10 applies force to the needle 16*b* in the direction in which the needle comes out. This urges the pierced film part relatively to the needle 16*b* to the left in FIG. 3B, but the protrusion 162 prevents the film part from moving in this direction. Therefore, because the needle 16*b* does not come out, the pierced hole is kept closed.

As stated above, the protrusion 162 prevents the pierced film part from moving relatively to the needle 16*b* toward the front end of the needle. This avoids the problem that the relative movement would entrain air into the cartridge 10 and therefore affect the detection of the amount of the remaining ink.

The protrusion 162 might not be limited to the spherical form shown in FIG. 3B. Instead, the protrusion 162 might take the form of at least two plates or columns formed on the cylindrical member 161 so that the cartridge bottom 11 might be positioned between them.

Figure 3C:
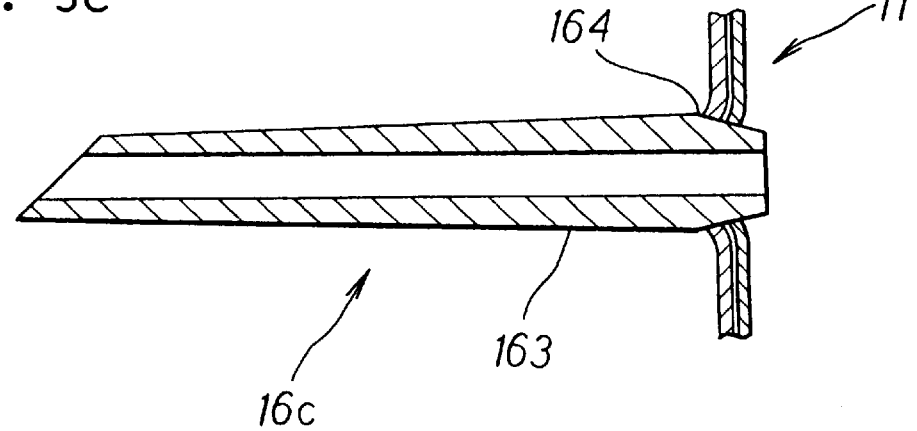

FIG. 3C shows still another tubular needle 16*c* which may replace the needle 16. This needle 16*c* includes a front taper part 163 and a rear stop part 164. The peripheral surface of the front part 163 tapers toward the front end of the needle 16*c*. The peripheral surface of the rear part 164 tapers toward the root of the needle 16*c* (to the right in FIG. 3C).

When this needle 16*c* pierces the cartridge bottom 11, the pierced hole is enlarged gradually, and therefore its diameter does not change rapidly. Consequently, no cracks develop in the bottom 11. After the needle 16*c* pierces the film 11, the internal pressure of the ink in the cartridge 10 applies force on the needle 16*c* in the direction in which the needle comes out. The stopper 164 prevents the needle 16*c* from coming out, and air from being entrained as stated above. Besides, as is the case with the needle 16*a* shown in FIG. 3A, the junction between the needle 16*c* and the pierced film part is prevented from being loose. It is therefore possible to effectively prevent air from entering the cartridge 10, and to achieve constantly good detection of the amount of the remaining ink.

The invention is not limited to the above embodiments. The following modifications for sensors may be made. For example, each of the sensors 18*a* and 18*b* as detectors may be a pressure sensor made of rubber with conductive filler compounded into the rubber. Each of these sensors may, however, be replaced by a sensor including a known piezoelectric element.

Figure 5:
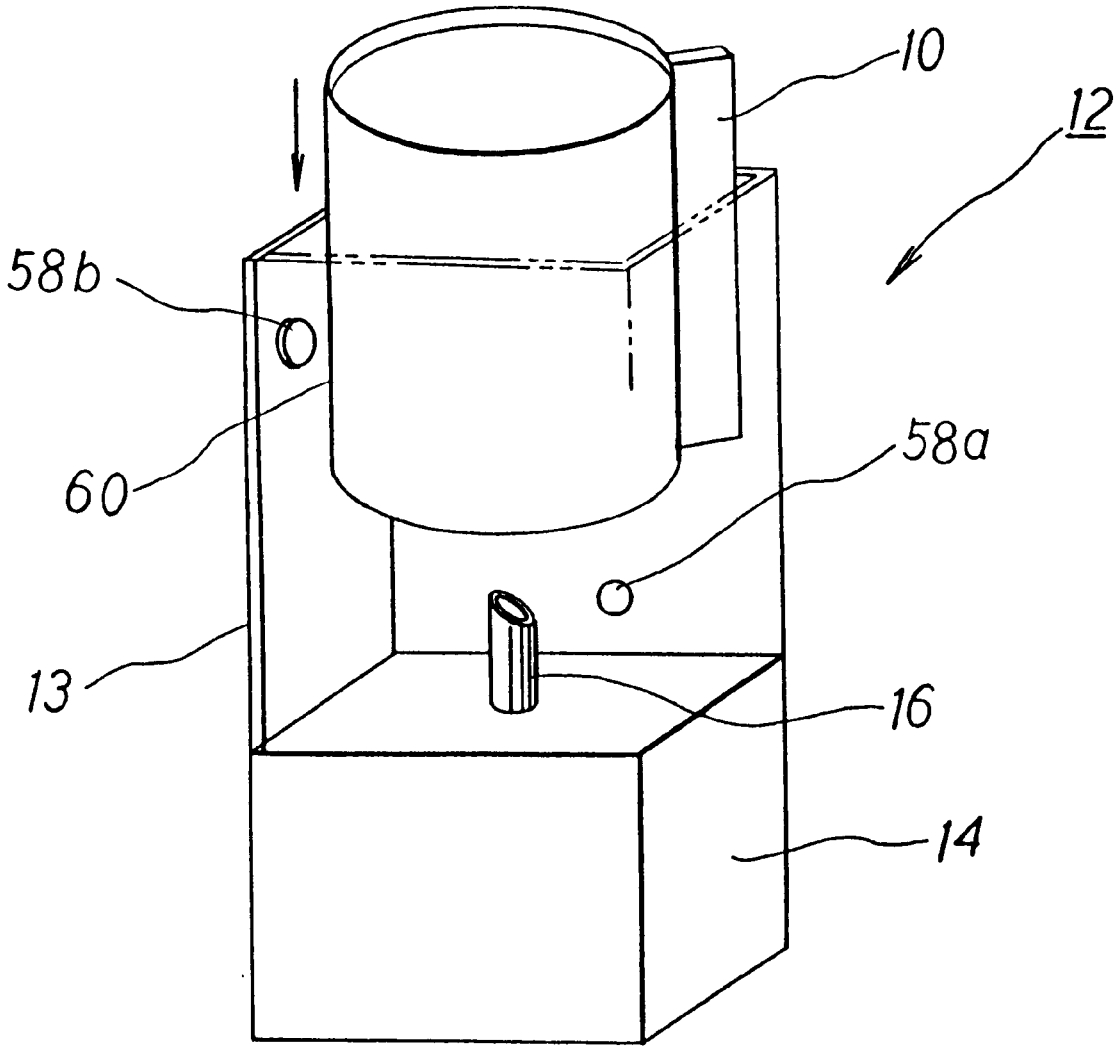
FIG. 5 is a schematic perspective view of another liquid ink feeder according to the invention.
Figure 6:
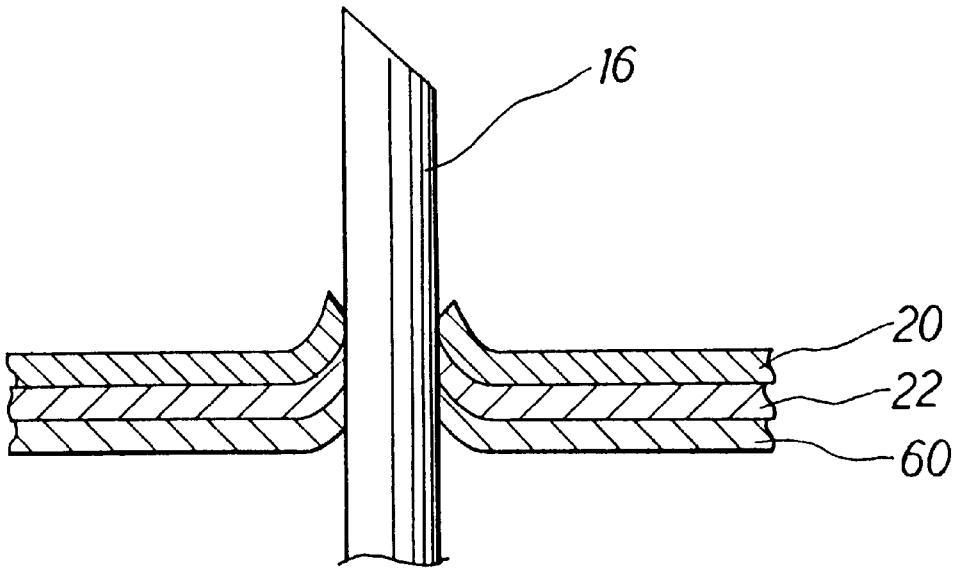
FIG. 6 is an enlarged side view, partially in section, of part of the feeder shown in FIG. 5.
Figure 7:
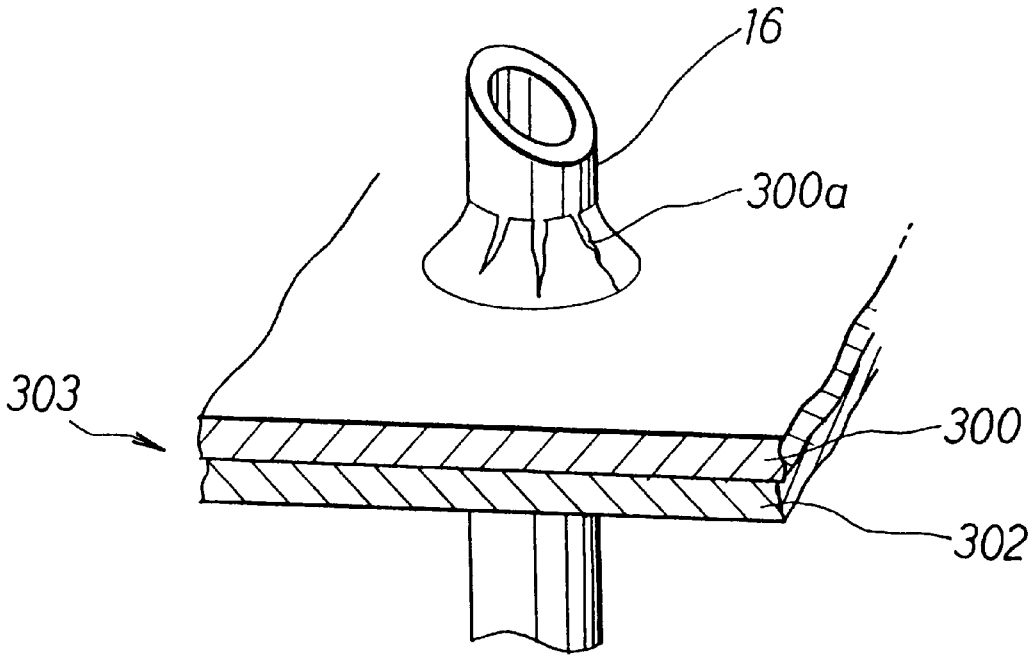
Fig. 7 (Prior Art)
FIG. 7 is a view similar to FIG. 4, but showing a conventional liquid ink feeder.

With reference to FIGS. 5 and 6, another liquid ink feeder 12 according to the invention includes a box 13, an ink jet drive 14 and a metal needle 16, which are equivalent to the parts 13, 14 and 16, respectively, shown in FIGS. 1–4.

As shown in FIG. 5, an ink cartridge 10 is similar to the cartridge 10 shown in FIG. 1, but is covered with an electrically conductive film 60, which may be aluminum foil. Two electrodes 58*a* and 58*b* are mounted as detectors on inner surfaces of the box 13. The metal needle 16, conductive film 60 and electrodes 58*a* and 58*b* form a circuit. By measuring the impedance of the circuit with a measuring device (not shown), which is fitted in the ink jet drive 14, it is possible to detect, by means of simple construction, the amount of the ink remaining in the cartridge 10.

By measuring the electrostatic capacity between the cartridge and sensors, instead of the impedance, it is also possible to find out the amount of the remaining ink from the capacity change.

As apparent from the foregoing, the invention makes it possible to provide an ink cartridge which is free of ink leakage, effective in preventing air from entering the cartridge, simple in structure, and low in production costs. It is also possible to provide an ink feeder of relatively simple structure by using such a cartridge.

The present invention is not limited to the foregoing embodiments, but various modifications can be made without departing from the spirit and scope of the invention. The invention is not necessarily limited to the structure of the printer shown in the above embodiment. The invention can also be applied to various recorders each for use with a replaceable ink cartridge. Of course, the invention can be applied to automatically movable printers and portable (scanning type) printers as well.

What is claimed is:

1. An ink cartridge comprising ink and a sealed bag in which the ink is stored, the bag being formed out of a laminate which includes films different in ductility, the laminate having a surface, at least one of the films having compressive residual stress in directions along the surface of the laminate.

2. The cartridge defined in claim 1 wherein the films have different coefficients of thermal expansion, the films being bonded together at high temperature and thereafter cooled to form the laminate.

3. The cartridge defined in claim 1 wherein at least one of the films is made of non-oriented synthetic resin.

4. The cartridge defined in claim 1 wherein the laminate further includes adhesive layer between adjacent two of the films.

5. The cartridge defined in claim 1 wherein the bag is formed by folding the laminate in two and heat-sealing adjacent edges of the folded laminate.

6. The cartridge defined in claim 1 wherein the films include a non-oriented nylon film and a linear chain low-density polyethylene film which are laminated together through an adhesive layer.

7. The cartridge defined in claim 1 wherein the inmost film of the laminate, which is in contact with the ink, functions as an ink sealing layer, which is more ductile than any other layer of the laminate.

8. The cartridge defined in claim 7, wherein the at least one of the films having the compressive residual stress is a different film from the sealing layer, and has a lower coefficient of thermal expansion than the sealing layer.

9. The cartridge defined in claim 7 wherein the sealing layer is made of polyolefine resin.

10. A process for forming an ink cartridge in bag form which includes first and second layers laminated together, the process comprising the steps of:

forming a laminate by bonding the first layer and the second layer through an adhesive layer at high temperature, the first layer having a lower coefficient of thermal expansion than the second layer;

cooling the laminate to develop compressive residual stress in the first layer;

folding the cooled laminate in two; and bonding adjacent edges of the folded laminate together to form the ink cartridge in bag form.

11. The process defined in claim 10 wherein the second layer functions as an ink sealing layer in contact with the ink, the sealing layer being made of material which is more ductile than the first layer.

12. The process defined in claim 10 wherein at least one of the first and second layers is a non-oriented synthetic resin film.

13. The process defined in claim 10 wherein the first layer is made of polyolefine resin.

14. The process defined in claim 13 wherein the first layer is a linear chain low-density polyethylene film, while the second layer is a non-oriented nylon film.

15. The process defined in claim 10 wherein the edges of the laminate are bonded together by being heat-sealed.

16. An ink feeder comprising:

an ink head for ejecting ink;

a needle having an ink passage formed therein, the passage communicating with the head; and a sealed ink cartridge in bag form which is filled with the ink, the cartridge being formed out of a laminate which includes films different in ductility, the laminate having a surface, at least one of the films having compressive residual stress in directions along the surface of the laminate;

the needle piercing directly the films of the cartridge in order to feed the ink out of the cartridge to the head.

17. The feeder defined in claim 16, further comprising a box for housing the cartridge therein and a sensor fitted on an inner surface of the box for detecting a contact pressure applied thereto by the cartridge in order to determine an amount of the ink remaining in the cartridge.

18. The feeder defined in claim 16, further comprising a box for housing the cartridge therein and a sensor fitted on an inner surface of the box for detecting at least one of a resistance and a capacitance between the sensor and the cartridge in order to determine an amount of the ink remaining in the cartridge.

19. The feeder defined in claim 16 wherein the needle is tapered.

20. The feeder defined in claim 16 wherein the needle is thicker toward a front end thereof.

21. The feeder defined in claim 16 wherein the needle is tubular and includes a protrusion formed on a periphery thereof for preventing the needle from coming out of the cartridge pierced by the needle.

22. The feeder defined in claim 16 wherein the films have different coefficients of thermal expansion, the films being bonded together at high temperature and thereafter cooled to form the laminate.

23. The feeder defined in claim 16 wherein at least one of the films is made of non-oriented synthetic resin.

24. The feeder defined in claim 16 wherein the laminate further includes adhesive layer between adjacent two of the films.

25. The feeder defined in claim 16 wherein the bag is formed by folding the laminate in two and heat-sealing adjacent edges of the folded laminate.

26. The feeder defined in claim 16 wherein the films include a non-oriented nylon film and a linear chain low-density polyethylene film which are laminated together through an adhesive layer.

27. The feeder defined in claim 16 wherein the head is an ink head for use with an ink jet printer.

28. The feeder defined in claim 16 wherein the inmost film of the laminate, which is in contact with the ink, functions as an ink sealing layer, which is more ductile than any other layer of the laminate.

29. The feeder defined in claim 28, wherein the at least one of the films having compressive residual stress is a different film from the sealing layer, and has a lower coefficient of thermal expansion than the sealing layer.

30. The feeder defined in claim 28 wherein the sealing layer is made of polyolefine resin.

* * * * *